US005114311A

United States Patent [19]

Becker et al.

[11] Patent Number: 5,114,311

[45] Date of Patent: May 19, 1992

[54] CENTRIFUGAL PUMP WITH INNER AND OUTER CASINGS

[75] Inventors: Karlheinz Becker; Gunter Pfeiffer-Müller, both of Worms, Fed. Rep. of Germany

[73] Assignee: KSB Aktiengesellschaft, Frankenthal, Fed. Rep. of Germany

[21] Appl. No.: 658,172

[22] Filed: Feb. 20, 1991

[30] Foreign Application Priority Data

Feb. 21, 1990 [DE] Fed. Rep. of Germany ..... 4005414
Dec. 22, 1990 [DE] Fed. Rep. of Germany ..... 4041545

[51] Int. Cl.[5] ..... F01D 1/00
[52] U.S. Cl. ..... 415/182.1
[58] Field of Search ..... 415/182.1, 196, 203, 415/206, 208.1, 224.5, 186

[56] References Cited

FOREIGN PATENT DOCUMENTS 346268 12/1978 Austria .
2231128 1/1973 Fed. Rep. of Germany .
2257949 7/1980 Fed. Rep. of Germany .
0180823 6/1922 United Kingdom ..... 425/182.1

*Primary Examiner*—Edward K. Look
*Assistant Examiner*—Christopher M. Verdier
*Attorney, Agent, or Firm*—Peter K. Kontler

[57] ABSTRACT

A centrifugal pump with an outer casing which has one or more discharge branches, with an inner casing which is installed in the outer casing and rotatably surrounds a pump shaft, and an impeller which is mounted on the shaft at the inlet of the outer casing has one or more fluid flow guiding inserts, one for each discharge branch, in an annular chamber between the inner and outer casings. The inserts are offset relative to the respective discharge branches in the direction of rotation of the shaft and have front faces provided on spur-shaped front portions immediately behind the exit end of the impeller. The inserts further have guide surfaces including first sections adjacent the inner casing, second sections adjacent the outer casing, and third sections which direct a portion of the fluid medium directly from the exit end of the impeller to the corresponding discharge branches. The guide surfaces establish for the fluid medium a path which resembles that defined by the thread on a shank forming part of a screw and having a diameter which increases in a direction from the exit end of the impeller toward the discharge branches of the other casing.

16 Claims, 4 Drawing Sheets

CENTRIFUGAL PUMP WITH INNER AND OUTER CASINGS

BACKGROUND OF THE INVENTION

The invention relates to centrifugal pumps in general, and more particularly to improvements in guide means for the flow of a fluid medium from the inlet to the outlet of a centrifugal pump. Still more particularly, the invention relates to improvements in guide means for the flow of a fluid medium from the exit end of the impeller to the outlet of a centrifugal pump.

German Auslegeschrift No. 22 57 949 discloses a centrifuqal pump with a mixed flow impeller and an energy converting guide wheel which is located at the exit end of the impeller and serves to direct the flow of fluid into an elbow which, in turn, directs the fluid into a radially outwardly extending discharge branch of the outer casing of the pump. The fluid medium must flow through the guide wheel and is thereupon caused to flow through an inner casing which is installed in the outer casing and is provided with one or more bearings for the pump shaft. The efficiency of the pump is unsatisfactory due to the aforedescribed guidance of the fluid, and the initial cost is high.

Austrian Pat. No. 347 268 discloses a pump with an axial or mixed flow impeller. The outer casing of the pump is provided with an inlet in the form of a suction branch and with an outlet in the form of a radially disposed discharge branch. The outer casing confines an inner casing which rotatably carries a shaft for the impeller. The inner casing is called a supporting tube and its outer diameter increases gradually from the exit end of the impeller to the discharge branch. The patented pump further comprises a deflecting shield which is disposed between the inner and outer casings and cooperates with channels in the internal surface of the outer casing to direct the fluid flow toward the discharge branch. The deflecting shield is provided with a wedge which is located opposite the discharge branch of the outer casing. The fluid stream which issues from the impeller is oriented by the deflecting shield and flows through the space between the inner and outer casings in substantial parallelism with the axis of the pump shaft. The aforementioned wedge serves to divide the fluid stream into two branches which flow along the exterior of the inner casing and toward the discharge branch. In order to reduce losses, the outer casing is provided with two additional channels which are formed in its internal surface opposite the discharge branch. These channels contribute to the cost of the outer casing and of the entire centrifugal pump. Furthermore, the shield contributes unduly to the axial length of the pump.

Published German patent application No. 22 31 128 discloses a spherical housing for use in reactor pumps. The fluid-admitting and fluid-discharging chambers are disposed in one and the same casing. Flow guiding elements are installed in the fluid admitting portion of the spherical housing, and similar flow guiding elements are installed in the fluid discharging portion. The housing of this pump is complex and expensive.

OBJECTS OF THE INVENTION

An object of the invention is to provide a simple, compact and inexpensive centrifugal pump wherein the fluid medium which flows from the inlet to the outlet is guided in a novel and improved way.

Another object of the invention is to provide novel and improved casings for use in the above outlined centrifugal pump.

A further object of the invention is to provide novel and improved means for guiding the fluid medium between the inner and outer casings of the above outlined centrifugal pump.

An additional object of the invention is to provide a centrifugal pump whose efficiency exceeds that of conventional pumps.

Still another object of the invention is to provide a novel and improved method of guiding the fluid medium from the exit end of the impeller toward the discharge branch or discharge branches of a centrifugal pump.

SUMMARY OF THE INVENTION

The invention resides in the provision of a centrifugal pump which comprises an outer casing having a fluid-admitting inlet and an outlet including at least one lateral fluid discharge branch, an inner casing which is disposed in and defines with the outer casing a chamber serving to connect the inlet with the outlet, a pump shaft which is rotatably journalled in the inner casing, an impeller which is mounted on the shaft (for rotation in a predetermined direction) between the inlet and the chamber and has an exit end at the chamber, and fluid flow controlling guide means including at least one insert in the chamber. The outer diameter of the inner casing increases from the exit end of the impeller toward the outlet, and the insert has a front face (e.g., a front face composed of inner and outer sections or portions) which is adjacent the exit end of the impeller. The insert further includes a composite guide surface which is adjacent and is flanked by the two casings. The front face of the insert is offset relative to the center of the at least one discharge branch in the predetermined direction, and the guide surface includes a first section nearer to the inner casing and a second section nearer to the outer casing. The first and second sections of the guide surface extend in the predetermined direction from the front face, and the guide surface further includes a third section which extends counter to the predetermined direction and is nearer to the at least one discharge branch than the first and second sections.

If the outlet comprises a plurality of discharge branches (e.g., two discharge branches which extend radially or nearly radially of the outer casing and are disposed substantially diametrically opposite each other), the guide means preferably comprises one insert for each discharge branch.

The third section of the guide surface is or can be steeper than the first and second sections. The arrangement may be such that the guide surface is stepped and that each of the first and second sections constitutes a step of the guide surface.

The first section of the guide surface is more distant from and the second section of the guide surface is nearer to the exit end of the impeller (as seen in the axial direction of the pump shaft).

The outer casing can include a substantially funnel-shaped (e.g., substantially frustoconical) portion which is disposed between the chamber and the at least one, preferably substantially radially oriented, discharge branch. The surface bounding the funnel-shaped portion can taper in a direction from the chamber toward the at least one discharge branch.

The outer casing can be provided with at least one internal recess which is located between the chamber and the at least one discharge branch and extends substantially circumferentially of the at least one discharge branch.

The extent of offset of the front face of the insert relative to the center of the at least one discharge branch is preferably less than, or at most equals, the width of the at least one discharge branch in the direction of fluid flow from the exit end of the impeller (i.e., from the inlet) to the at least one discharge branch.

The at least one insert can constitute a discrete (separately produced) part which is insertable into and removable from the chamber between the inner and outer casings of the improved centrifugal pump. Alternatively, the at least one insert can constitute an integral part of the inner or outer casing. At least one of the casings and/or the at least one insert can constitute a casting.

The novel features which are considered as characteristic of the invention are set forth in particular in the appended claims. The improved centrifugal pump itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
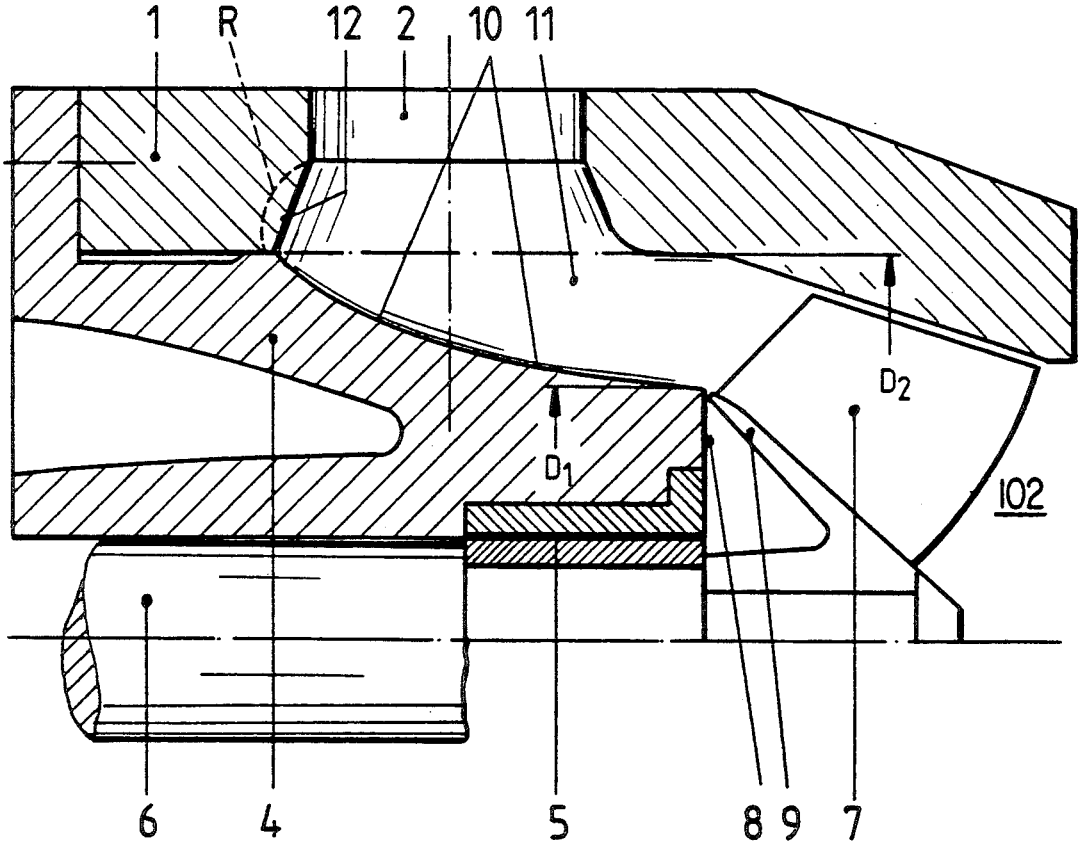
FIG. 1 is a fragmentary axial sectional view of a centrifugal pump which embodies one form of the invention, the section being taken in the direction of arrows as seen from the line I—I in FIG. 2.
Figure 2:
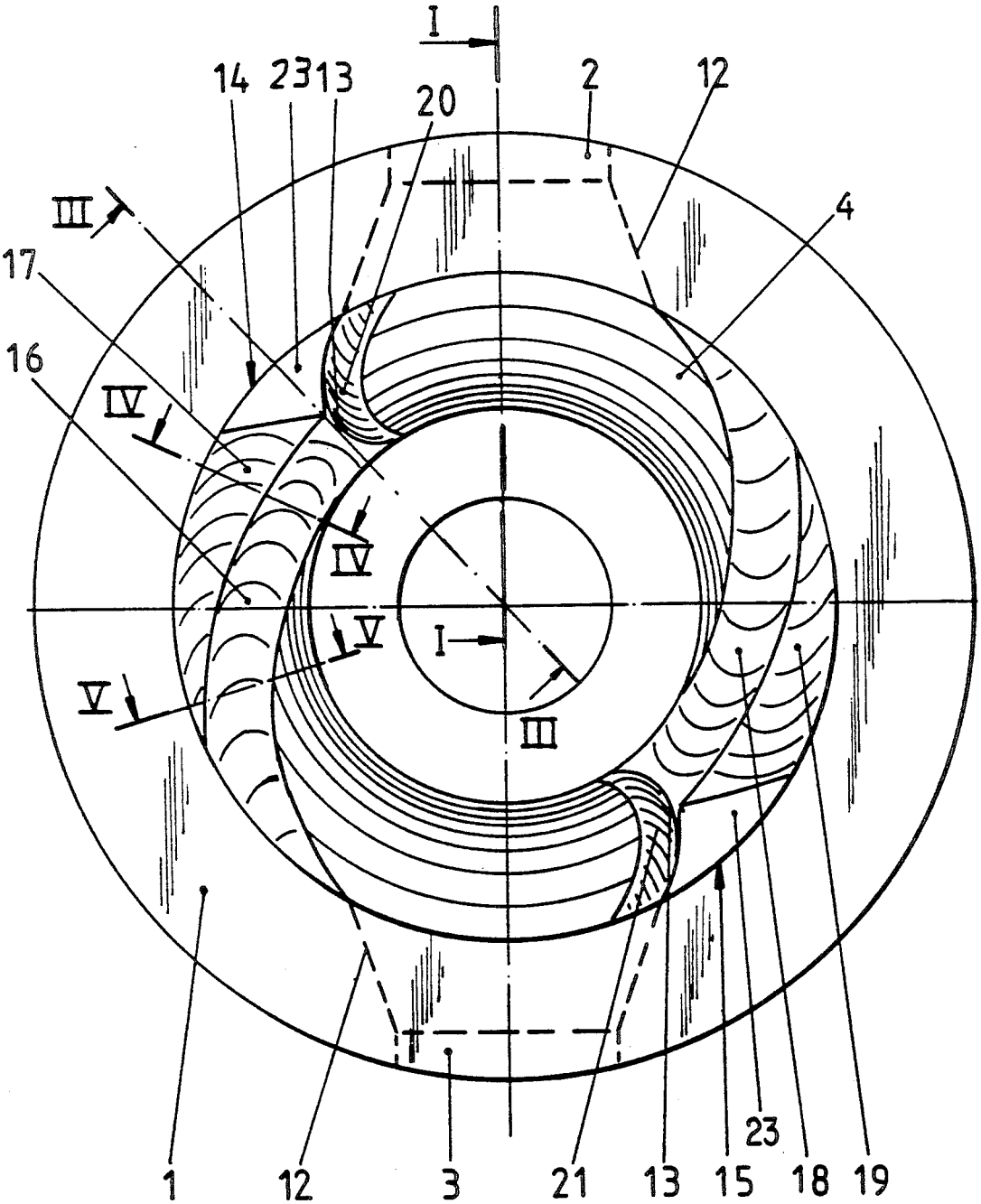
FIG. 2 is an end elevational view of the pump but with the pump shaft and the impeller omitted.
Figure 3:
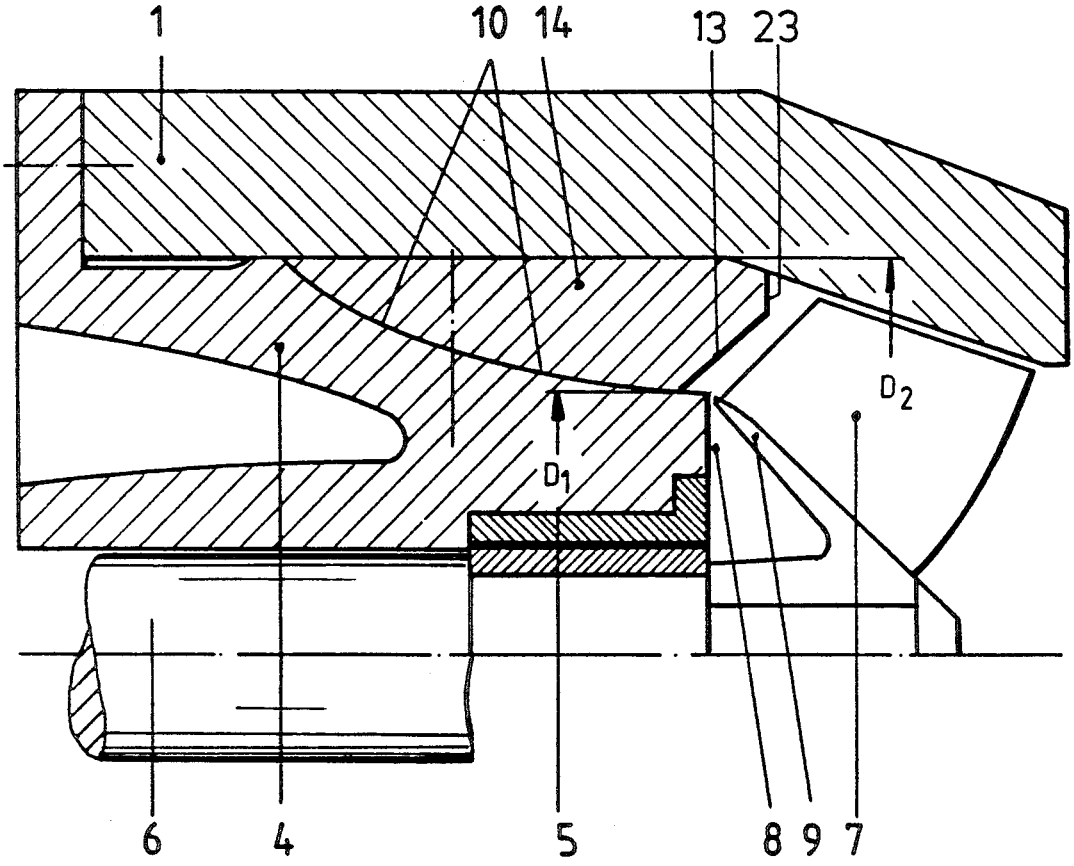
FIG. 3 is a fragmentary axial sectional view as seen in the direction of arrows from the line III—III in FIG. 2.

Referring to FIGS. 1, 2 and 3, the improved centrifugal pump comprises a composite housing including a substantially cylindrical outer casing 1 with an outlet including two radially extending pump discharge branches 2, 3 which are located diametrically opposite each other with reference to the axis of the pump shaft 6, and an inner casing 4 which is confined in the outer casing 1 and is provided with a bearing 5 for the shaft 6. The fluid-admitting inlet 102 of the outer casing 1 is located in front of an impeller 7 which is affixed to the illustrated end of the shaft 6 (namely to that end which is remote from the driven end), and the impeller's exit end or high-pressure end is defined by a conical skirt 9 which extends close to the end face 8 of the inner casing 4. The exact configuration and/or location of the inlet 102 forms no part of the present invention.

The inner casing 4 is inserted into the outer casing 1 in a direction from the driven end of the pump shaft 6. The illustrated impeller 7 is an open mixed flow impeller; however, it is equally possible to employ other types of impellers, for example, an axial or radial open or closed impeller, without departing from the spirit of the invention.

The configuration of the external surface of the skirt is such that it establishes a satisfactory hydrodynamic transition for the flow of a fluid medium from the impeller 7 toward and along the external surface 10 of the inner casing 4. The diameter of the external surface 10 increases gradually in a direction toward and between the discharge branches 2, 3 of the outer casing 1. In contrast to conventional centrifugal pumps, the annular chamber 11 between the casings 1, 4 immediately behind the impeller 7 does not contain a standard wheel-shaped diffuser or guide wheel. Furthermore, the outer casing 1 has two funnel-shaped or frustoconical portions 12 which connect the adjacent rear portion of the chamber 11 with the discharge branches 2 and 3. The funnel-shaped portions 12 taper in directions from the chamber 11 toward the respective discharge branches 2 and 3 of the outer casing 1, i.e., the cross-sectional area of each portion increases in a direction toward the inner casing 4 and the shaft 6. Such configuration of transition zones between the discharge branches 2, 3 and the chamber 11 ensures a highly satisfactory flow of fluid medium between the casings 1, 4 as well as radially outwardly and out of the outer casing.

Those surfaces of the casings 1 and 4 which guide the fluid medium on its way from the exit end of the impeller 7 into the discharge branches 2, 3 are disposed between an inner diameter $D_1$ (which is the minimum diameter of the illustrated part of the inner casing 4) and an outer diameter $D_2$ (which is the inner diameter of the outer casing 1 in the regions of radially inner ends of the funnel-shaped portions 12). The chamber 11 contains fluid flow controlling guide means including two discrete inserts 14 and 15 which are disposed in the annular space having an inner diameter $D_1$ and an outer diameter $D_2$. As can be seen in FIG. 3 (which shows only the insert 14), the guide means extends substantially from the exit end of the impeller 7 to the rearmost zones of the funnel-shaped portions 12. The inner diameter of the major part of the outer casing 1 is substantially constant (with the exception of the part surrounding the impeller 7) and equals or approximates $D_2$.

FIG. 2 is a front elevational view of the improved centrifugal pump but with the shaft 6 and impeller 7 omitted. The inserts 14, 15 of the guide means are located substantially diametrically opposite each other (with reference to the axis of the inner casing 4) and each of these inserts has a composite front face 13, 23 and a composite guide surface. The guide surface of the insert 14 comprises a first or inner section 16 which is nearer to the inner casing 4, a second or outer section 17 which is nearer the outer casing 1, and a third section 20 which is nearest to the respective discharge branch 2. The guide surface of the insert 15 includes a first or inner section 18 adjacent the inner casing 4, a second or outer section 19 adjacent the outer casing 1, and a third section 21 which is nearest the respective discharge branch 3. It will be noted that the number of inserts matches the number of discharge branches which together constitute the outlet of the outer casing 1. The insert 14 is or can be identical with the insert 15, and the spur-shaped front portion (with front face 13, 23) of each of these inserts is offset relative to the respective discharge branch 2, 3 in the direction of rotation of the shaft 6 and impeller 7 relative to the inner casing 4. In FIG. 2, the offset is substantially 45° (note the angle between the lines I—I and III—III). Such offset permits disburbance-free flow of fluid along t he inserts 14, 15 to the respective discharge branches 2, 3.

At least the surface sections 16, 17 of the guide surface of the insert 14 are concave (see FIGS. 4 and 5), and the same holds true for the sections 18, 19 of the insert 15. This is indicated in FIG. 2 by appropriate shading. The surface sections 16 and 18 are more distant from the end face 8 of the inner casing 4 than the sections 17 and 19 (this, too, can be seen in FIGS. 4 and 5). The spur-shaped front portion of each insert is provided with the respective composite front face 13, 23; such composite front face includes an inner section 13 which slopes forwardly from the inner casing 4 toward the outer casing 1 (see FIG. 3) and an outer section 23 which is or can be disposed in a plane extending at right angles to the axis of the shaft 6 and is located radially outwardly of the section 13 and inwardly of the adjacent portion of internal surface of the outer casing 1. The composite front face 13, 23 of each of the two inserts 14, 15 is offset in the aforedescribed manner, i.e., relative to the center line of the respective discharge branch 2, 3 and in the direction of rotation of the shaft 6 and impeller 7. The extent of offset of the front faces 13, 23 of the inserts 14, 15 need not exceed the width of the respective discharge branches 2, 3 in the direction of flow of fluid medium.

The curvature of sections 16, 17 and 18, 19 of guide surfaces on the inserts 14, 15 preferably varies in several directions. FIG. 2 shows that such sections bound cavities or grooves resembling those which are obtained by removing ice cream or a similar substance with a spoon which is moved first along the rim of a round ice-cream-filled container (outer casing 1) to form the sections 17, 19 and thereupon radially inwardly of the rim to form the sections 16, 18. The depth of the grooves increases in the axial direction of the container i.e., the sections 16, 17 and 18, 19 slope from the end face 8 toward the discharge branches 2, 3 not unlike the faces of an external screw thread on a bolt, feed screw or spindle (inner casing 4). The pitch or slope of the sections 16, 17 and 18, 19 may but need not be constant. This depends upon the availability of space between the exit end of the impeller 7 and the cross-sectional areas of the discharge branches 2, 3. The exact slope of sections 16, 17 and 18, 19 will be selected with a view to ensure optimum flow of fluid from the impeller 7 to the discharge branches 2, 3.

Figure 5:
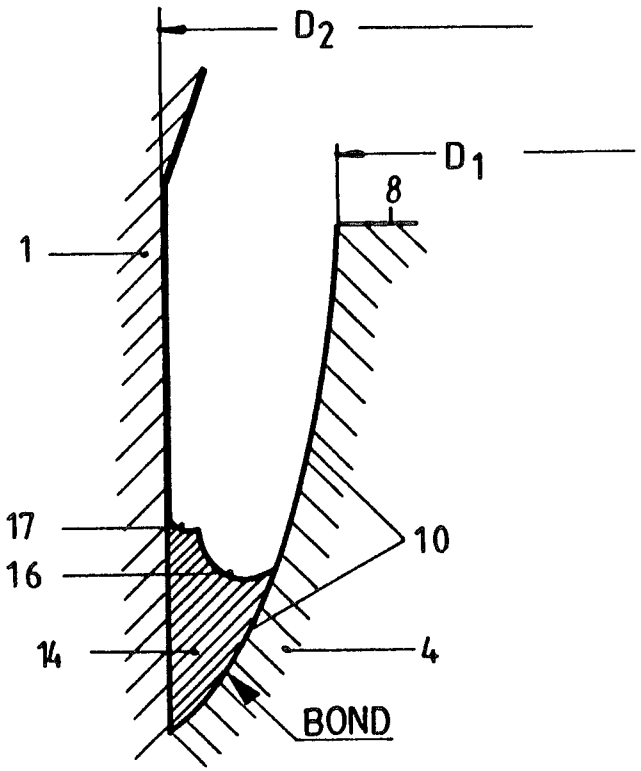
FIG. 5 is a similar fragmentary sectional view of the casings and of one of the inserts as seen in the direction of arrows from the line V—V in FIG. 2.
Figure 4:
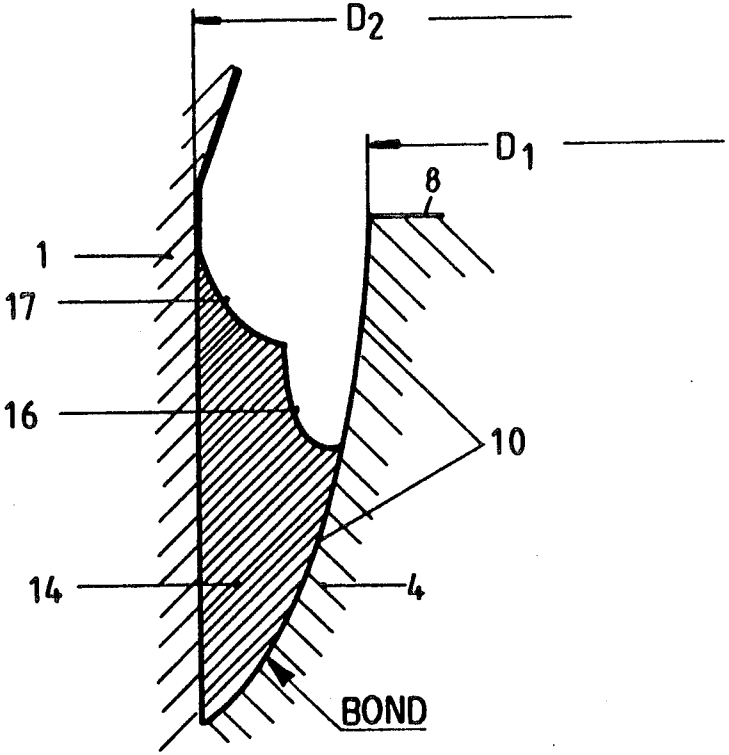
FIG. 4 is a fragmentary sectional view of the two casings and of one of the inserts as seen in the direction of arrows from the line IV—IV in FIG. 2.

The composite guide surface of each of the inserts 14, 15 is or can be stepped in a manner as shown in FIGS. 4 and 5, i.e., each of the sections 16, 17 of the composite guide surface of the insert 14 and each of the sections 18, 19 of the composite guide surface of the insert 15 can constitute one step of the respective composite guide surface. The sections 16, 18 are more distant from the observer of FIG. 2 than the sections 17 and 19, i.e., the sections 16 and 18 are nearer to the respective discharge branches 2, 3 than the sections 17 and 19. The external surface 10 of the inner casing 4 is a concavo-conical surface, and this is indicated in FIG. 2 by partly circular shade lines radially inwardly of the discharge branches 2 and 3. Such configuration of the external surface 10 promotes satisfactory flow of a fluid medium from the exit end of the impeller 7 toward the discharge branches 2 and 3, namely a flow which is more satisfactory than that which can be achieved in conventional centrifugal pumps with a standard guide wheel behind the impeller or by utilizing a volute casing. In addition, the dimensions of the composite casing 1, 4 can be reduced to a fraction of dimensions of the casing in a conventional centrifugal pump with the same output. Thus, the improved pump can be used when it is desirable to employ a highly compact high-performance centrifugal pump.

As mentioned above, the third sections 20, 21 of composite guide surfaces of the inserts 14, 15 are nearer to the respective discharge branches 2, 3 than the corresponding surface sections 16, 17 and 18, 19. The positions of the sections 20, 21 are selected in such a way that they can be said to divide the chamber 11 in the axial direction of the casings 1 and 4. The sections 20, 21 can be said to bound substantially throat-shaped or recessed portions of the respective inserts 14 and 15. This also applies for the configuration of the first and second sections 16, 17 of the guide surface of the insert 14 and for the first and second sections 18, 19 of the guide surface of the insert 15. Such configuration of the guide surfaces 16, 17, 20 and 18, 19, 21 ensures that the inserts 14 and 15 bring about desirable smooth and gentle deflection or change in the direction of flow of fluid medium from the impeller 7 toward and into the discharge branches 2 and 3. The surface sections 20 and 21 are or can be nearly parallel to the axis of the shaft 6; actually, they define slightly arcuate paths for the flow of a fluid medium along the respective portions of the inserts 14 and 15.

The sections 16, 17 and 18, 19 of guide surfaces on the inserts 14, 15 are inclined with reference to the plane of end face 8 of the inner casing 4. The inner section or edge 13 and the outer section 23 of the front faces of the inserts 14, 15 constitute the front ends of the respective sections 16, 17 and 18, 19. The inclination of the sections 16, 17 and 18, 19 relative to the plane of the end face 8 is changed if the distance of the end face 8 from the discharge branches 2, 3 is increased or reduced.

FIGS. 3, 4 and 5 show that the insert 14 is a separately produced part which can be inserted into and removed from the chamber 11. This also applies for the insert 15. However, it is equally within the purview of the invention to make the inserts 14, 15 integral with the inner casing 4 or with the outer casing 1. This depends on the preference of the manufacturer and on the nature of available equipment. Even if the inserts 14, 15 are separately produced parts, they can be integrally bonded to the internal surface of the outer casing 1 or to the external surface 10 of the inner casing 4. This is shown by the legend "BOND" in each of FIGS. 4 and 5, i.e., the insert 14 is or can be a separately produced part which is thereupon integrally connected to one of the casings 1, 4 by an adhesive, by welding or in any other suitable way.

FIGS. 4 and 5 show that the first or inner section 16 of the guide surface of the insert 14 is more distant from the end face 8 of the inner casing 4 (and hence from the exit end of the impeller 7) than the second or outer section 17. Analogously, the inner surface section 18 of the guide surface of the insert 15 is more distant from the impeller 7 than the outer surface section 19.

The flow of conveyed fluid medium from the impeller 7 toward the discharge branches 2 and 3 of the outlet is even more satisfactory if the outer sections 17, 19 of guide surfaces of the inserts 14, 15 are inclined with reference to the axis of the pump shaft 6. The configuration of the outer surface sections 17, 19 is comparable to that of the surface on a spiral which extends in the axial direction of the shaft 6 and the outer diameter of which increases in a direction from the exit end of the impeller 7 toward the discharge branches 2 and 3. Experiments with the improved centrifugal pump indicate that its efficiency is more satisfactory than that of heretofore known centrifugal pumps.

The section of FIG. 5 (see the line V—V in FIG. 2) is taken close to one end of the outer surface section 17, i.e., at a point where the flow of fluid medium toward the discharge branch 2 is controlled almost exclusively by the inner section 16 of the composite guide surface of the insert 14.

Experiments with the improved centrifugal pump further indicate that the efficiency is particularly satisfactory when the pump employs an axial or mixed flow impeller or propeller, i.e., when the $n_q$ (specific speed) is relatively high (in contrast to radial impellers whose $n_q$ is relatively low). Such types of pumps are often used to convey large quantities of fluid media at a low head. If the specific speed of the impeller is relatively low (e.g., if $n_q$ equals or approximates 50), the distance of the impeller 7 from the discharge branch or branches of the outer casing 1 can be reduced. In such pumps, the angle between a tangent to the peripheral surface and the sections of the guide surface on an insert can be reduced accordingly.

The inner casing 4, the outer casing 1 and/or the insert 14 and/or 15 can constitute a metallic casting.

The making of one or more inserts as separately produced part(s) exhibits the advantage that the casing 1 and/or 4 can be more readily tested than if it were integrally connected with one or more inserts.

An important advantage of the improved centrifugal pump is that losses during flow of a fluid medium beyond the exit end of the impeller 7 and through the chamber 11 between the impeller and the outlet of the outer casing 1 are a fraction of losses in a conventional pump. An advantage of a pump which employs a single insert (i.e., wherein the outlet includes a single discharge branch) is that shock losses develop only at the front face of the single insert. The insert or inserts (and more particularly their guide surfaces) convert the chamber 11 into a fluid flow conveying space, the effect or function of which is analogous to that of a spiral chamber or volute chamber having a diameter which increases in the direction of flow of a fluid medium (particularly liquid) from the impeller toward the outlet of the outer casing 1. Otherwise stated, the surfaces bounding the chamber 11 which contains one or more inserts can be compared to the surfaces of the externally threaded shank of a screw. The difference is that the flanks of the thread forming part of the shank of a screw have a lead in the axial or longitudinal direction. On the other hand, the lead in the chamber 11 is in a direction toward the pump shaft 6. The aforediscussed offset of the front faces 13, 23 of the inserts 14, 15 relative to the centers of the respective discharge branches 2, 3 is desirable and advantageous because it ensures a highly satisfactory flow of fluid medium from the exit end of the impeller 7 to the discharge branches, not unlike the flow of a fluid stream along the flanks of a screw thread.

The third sections 20, 21 of guide surfaces of the inserts 14, 15 serve to guide that part of the stream of fluid medium which is nearest to the respective discharge branches; such part of the stream is caused to flow straight from the impeller to the respective discharge branches. The slope of the surface sections 20 and 21 is much steeper (with reference to a plane which is normal to the axis of the pump shaft and includes the impeller) than the slope of the surface sections 16, 17 (insert 14) and 18, 19 (insert 15). It can be said that the surface sections 20 and 21 extend from the respective front faces 13, 23 and more or less counter to the direction of flow of fluid medium toward the outlet of the outer casing 1. As already mentioned above, the surface sections 20, 21 can be said to extend substantially axially of the shaft 6 and to divide the chamber 11.

An advantage of the feature that the number of inserts matches or can match the number of discharge branches (which constitute the outlet of the outer casing 1) is that the flow of each stream of fluid medium is controlled in an optimum way, i.e., each discharge branch receives a fluid stream which is compelled to flow along the composite guide surface (such as 16, 17, 20 or 18, 19, 21) of a discrete insert. The flow of fluid medium is controlled primarily by the surface sections 16, 17 and 18, 19 while the surface sections 20, 21 prevent circulation of fluid medium in the chamber 11. The slope of sections of the guide surface on an insert can be constant or can vary; this often depends on the dimensions of space which is available for the composite casing and for the insert or inserts.

The aforediscussed mounting of inserts 14, 15 in such a way that their front faces 13, 23 are offset relative to the respective discharge branches 2, 3 in the direction of rotation of the impeller 7 is desirable on the additional ground that this establishes a large space immediately downstream of the exit end of the impeller 7; such large space is desirable because it ensures conversion of high-speed fluid medium issuing from the impeller into high-pressure fluid medium leaving the outer casing 1 by way of the discharge branches 2 and 3. If the chamber 11 contains two inserts (as actually shown in the drawing), the space immediately downstream of the impeller 7 is divided into two halves which receive fluid medium from the exit end of the impeller and the inserts cannot block the flow of fluid medium into the respective discharge branches. The spur-shaped front ends of the inserts 14, 15 are offset in the plane of the impeller 7 or in a second plane which is parallel to the plane of the impeller.

The feature that the composite guide surfaces of the inserts 14, 15 are stepped in such a way that the inner sections 16, 18 are more distant from the impeller 7 than the outer sections 17, 19 also contributes to higher efficiency of the improved pump. It has been found that such design ensures a stable flow of fluid medium through the chamber 11 and that the flow is free of turbulence all the way between the impeller 7 and the discharge branches 2 and 3.

The funnel-shaped portions 12 constitute an optional but desirable feature of the outer casing 1. Such funnel-shaped portions ensure gradual changes in the direction of fluid flow from the chamber 11 into the respective discharge branches. Gradual deflection of fluid flow is particularly important at those ends of the discharge branches 2 and 3 which are remotest from the impeller 7. This can be promoted by providing the internal surface of the outer casing 1 with one or more recesses R (one indicated in FIG. 1 by a broken line) which extend in the circumferential direction of the casings. It is possible to provide the outer casing 1 with several recesses R for each discharge branch; for example, with a pair of recesses which are located at opposite sides of the respective discharge branch. The recess or recesses R further reduce the likelihood of abrupt changes in the direction of fluid flow from the chamber 11 into the discharge branches 2 and 3. If the discharge branches 2, 3 are bounded by cylindrical surfaces, the flow of fluid medium is likely to be turbulent at the intake ends of the discharge branches. It has been ascertained that the provision of one or more recesses R greatly reduces the likelihood of turbulence at the locations where the fluid medium flows into cylindrical discharge branches because the recess or recesses enlarge the intake ends of the discharge branches. The just discussed recess or recesses can be provided in addition to or in lieu of the funnel-shaped portions 12. In either event, those portions of the outer casing 1 which define the discharge branches act not unlike nozzles.

The maximum offset of the front faces 13, 23 of the spur-shaped foremost ends of the inserts 14, 15 need not exceed the width of the discharge branches in the direction of the flow of fluid. The offset is preferably selected in such a way that the guide surfaces which are located downstream of the front faces 13, 23 of the inserts 14, 15 ensure disturbance-free transfer of fluid flow from the chamber 11 into the discharge branches 2 and 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A centrifugal pump comprising an outer casing having a fluid-admitting inlet and an outlet including at least one lateral fluid discharge branch; an inner casing disposed in and defining with said outer casing a chamber connecting said inlet with said outlet; a pump shaft rotatably journalled in said inner casing; an impeller mounted on said shaft between said inlet and said chamber for rotation in a predetermined direction; and fluid flow controlling guide means including at least one insert in said chamber, said inner casing having an outer diameter which increases from said impeller toward said outlet and said insert having a front face adjacent said impeller and a guide surface adjacent said casings, said front face being offset relative to the center of said at least one discharge branch in said predetermined direction and said guide surface including a first section nearer to said inner casing and a second section nearer to said outer casing, said first and second sections extending from said front face in said predetermined direction and said guide surface further including a third section which extends counter to said direction and is nearer to said at least one discharge branch than said first and second sections.

2. The pump of claim 1, wherein said outlet includes a plurality of lateral discharge branches and said guide means comprises one insert for each of said discharge branches.

3. The pump of claim 1, wherein said third section is steeper than said first and second sections.

4. The pump of claim 1, wherein said guide surface is stepped and each of said first and second sections constitutes a step of said guide surface.

5. The pump of claim 1, wherein said first section is more distant from and said second section is nearer to said impeller in the axial direction of said shaft.

6. The pump of claim 1, wherein said at least one discharge branch extends substantially radially of said shaft and said outer casing includes a substantially funnel-shaped portion disposed between said chamber and said at least one discharge branch and tapering toward said at least one discharge branch.

7. The pump of claim 1, wherein said outer casing has at least one internal recess disposed between said chamber and said at least one discharge branch and extending circumferentially of said at least one discharge branch.

8. The pump of claim 1, wherein said at least one discharge branch has a predetermined width in the direction of fluid flow from said inlet to said at least one discharge branch, said front face being offset by a distance which at most matches said width.

9. The pump of claim 1, wherein said at least one insert is a discrete part which is insertable into and removable from said chamber.

10. The pump of claim 1, wherein said at least one insert is an integral part of said outer casing.

11. The pump of claim 1, wherein said at least one insert is an integral part of said inner casing.

12. The pump of claim 1, wherein at least one of said casings is a casting.

13. The pump of claim 1, wherein said at least one insert is a casting.

14. The pump of claim 1, wherein said impeller is an axial impeller.

15. The pump of claim 1, wherein said impeller is a mixed flow impeller.

16. The pump of claim 1, wherein said impeller is open.

* * * * *